US009362695B2

(12) United States Patent
Yu et al.

(10) Patent No.: US 9,362,695 B2
(45) Date of Patent: Jun. 7, 2016

(54) ELECTRICAL CONNECTOR

(71) Applicant: ALLTOP ELECTRONICS (SUZHOU) LTD., Taicang, JiangSu Province (CN)

(72) Inventors: Wang-I Yu, Jhonghe (TW); Mao-Jung Huang, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 8 days.

(21) Appl. No.: 14/565,493

(22) Filed: Dec. 10, 2014

(65) Prior Publication Data

US 2016/0072242 A1 Mar. 10, 2016

(30) Foreign Application Priority Data

Sep. 5, 2014 (CN) ..... 2014 1 0451021

(51) Int. Cl.
*H01R 11/20* (2006.01)
*H01R 24/70* (2011.01)

(52) U.S. Cl.
CPC ..... *H01R 24/70* (2013.01)

(58) Field of Classification Search
CPC ..... H01R 4/2433; H01R 4/2404
USPC ..... 439/409, 391, 410, 387, 389, 435, 436, 439/393
See application file for complete search history.

(56) References Cited

U.S. PATENT DOCUMENTS

2009/0156027 A1* 6/2009 Chen ..... H01R 13/6485 439/83
2015/0244118 A1* 8/2015 Lin ..... H01R 24/60 439/357
2015/0288107 A1* 10/2015 Wu ..... H01R 3/6593 439/357

* cited by examiner

*Primary Examiner* — Phuongchi T Nguyen
(74) *Attorney, Agent, or Firm* — Sughrue Mion, PLLC

(57) ABSTRACT

An electrical connector includes an insulative housing, at least a contact module and a grounding member. The insulative housing has a body portion and a mating portion forwardly extending from the body portion. The mating portion is provided with a top wall, a bottom wall, a pair of side walls and a receiving space formed therebetween. The receiving space opens forwardly. The contact module has a plurality of contacts retained on the insulative housing. Each contact has a contact portion forwardly extending into the receiving space and a connecting portion backwardly extending out of the body portion. The grounding member has a middle grounding sheet and a pair of locking arms projecting into the receiving space. The middle grounding sheet is fixed in the body portion and spacing apart from the contacts along an up to down direction. The locking arms electrically connect with the middle grounding sheet.

20 Claims, 11 Drawing Sheets

ELECTRICAL CONNECTOR

BACKGROUND

1. Technical Field

The present disclosure relates to an electrical connector, and more particularly to an electrical connector with improved shielding effect.

2. Description of Related Art

Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method. As of 2008, the USB specification was at version 3.0. Previous notable releases of the specification were 0.9, 1.0, 1.1 and 2.0. For improving the transmission rate of USB 2.0 connector, USB 3.0 connector adds two pairs of differential signal contacts and one grounding contact being based on the USB 2.0 connector. The transmission rate of the USB 3.0 connector is 5 GB/s, and the USB 3.0 connector is compatible to existing standard USB 2.0 connector.

However, with rapid development of the electrical industry, even the USB 3.0 connector can not satisfy the transmission request of the electrical peripherals, and under increasing the transmission rate of the traditional connector, the traditional connectors also have an insufficient prevention from EMI, and the performance of the connector is adversely affected.

It is desirable to provide an improved electrical connector for solving above problems.

SUMMARY

In one aspect, the present invention includes an electrical connector. The electrical connector comprises an insulative housing having a body portion and a mating portion forwardly extending from the body portion, the mating portion being provided with a top wall, a bottom wall, a pair of side walls and a receiving space formed therebetween, the receiving space opening forwardly; at least a contact module having a plurality of contacts retained on the insulative housing, each contact having a contact portion forwardly extending into the receiving space and a connecting portion backwardly extending out of the body portion; and a grounding member having a middle grounding sheet and a pair of locking arms projecting into the receiving space, the middle grounding sheet being fixed in the body portion and spacing apart from the contacts along an up to down direction, and the locking arms electrically connecting with the middle grounding sheet.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
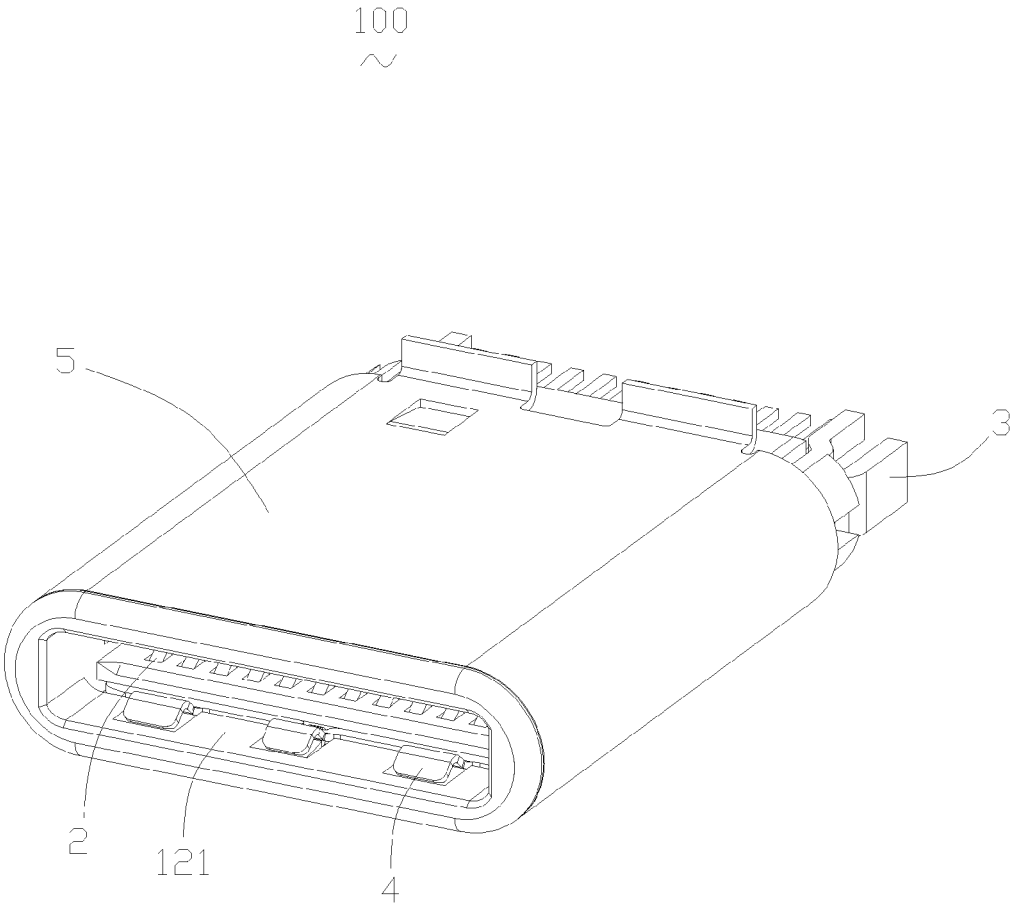
FIG. 1 is a perspective view illustrating a first embodiment of an electrical connector in the present disclosure.
Figure 2:
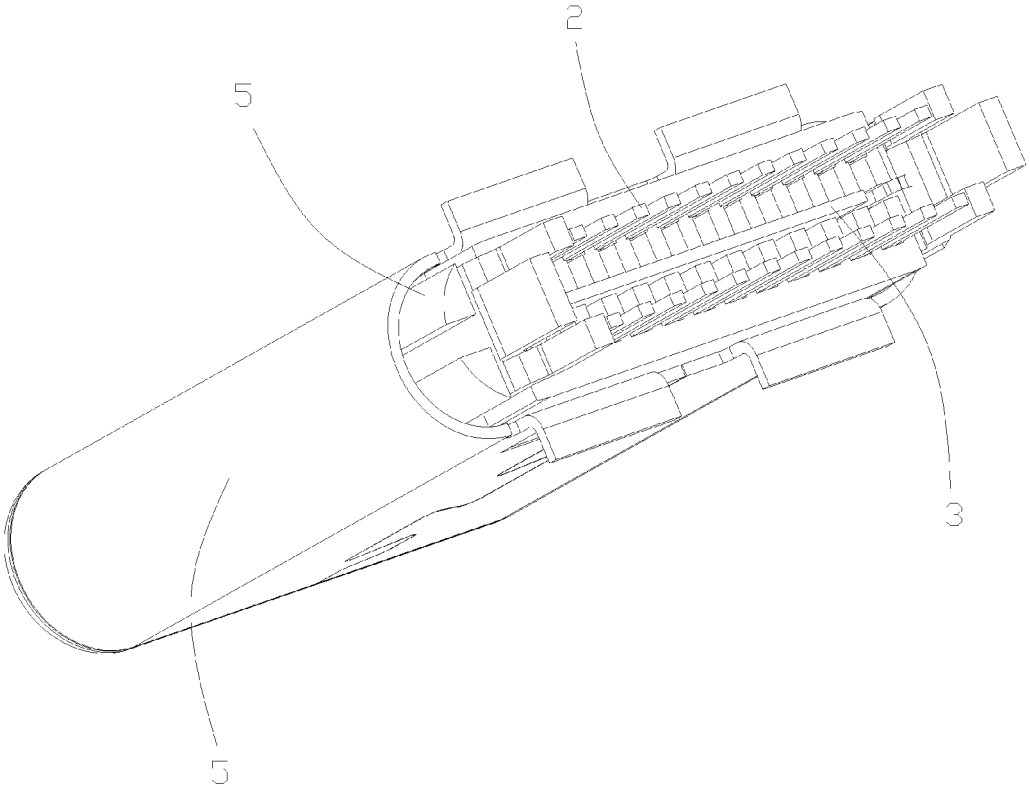
FIG. 2 is a view similar to FIG. 1, while viewed from another aspect.

Reference will now be made to the drawing figures to describe the embodiments of the present disclosure in detail. In the following description, the same drawing reference numerals are used for the same elements in different drawings.

Referring to FIGS. 1 to 6, a first illustrated embodiment of the present disclosure discloses an electrical connector 100 comprises an insulative housing 1, at least a contact module and a grounding member 3 retained in the insulative housing 1, a pair of shield blades 4 respectively located at upper and lower sides of the insulative housing 1, and an outer shield 5 surrounding the insulative housing 1. The contact module comprises a plurality of contacts 2.

Figure 3:
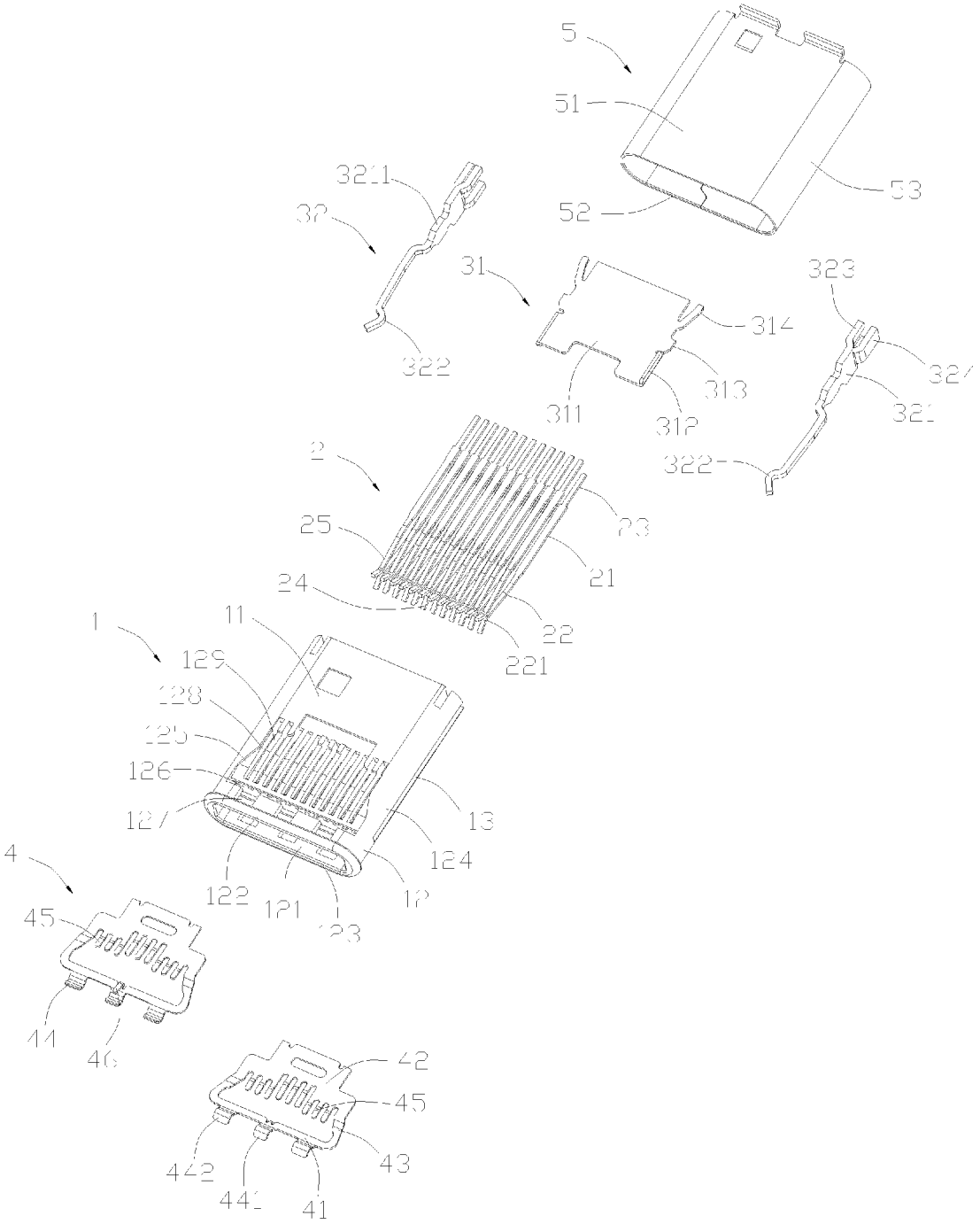
FIG. 3 is an exploded view of the electrical connector shown in FIG. 1.
Figure 4:
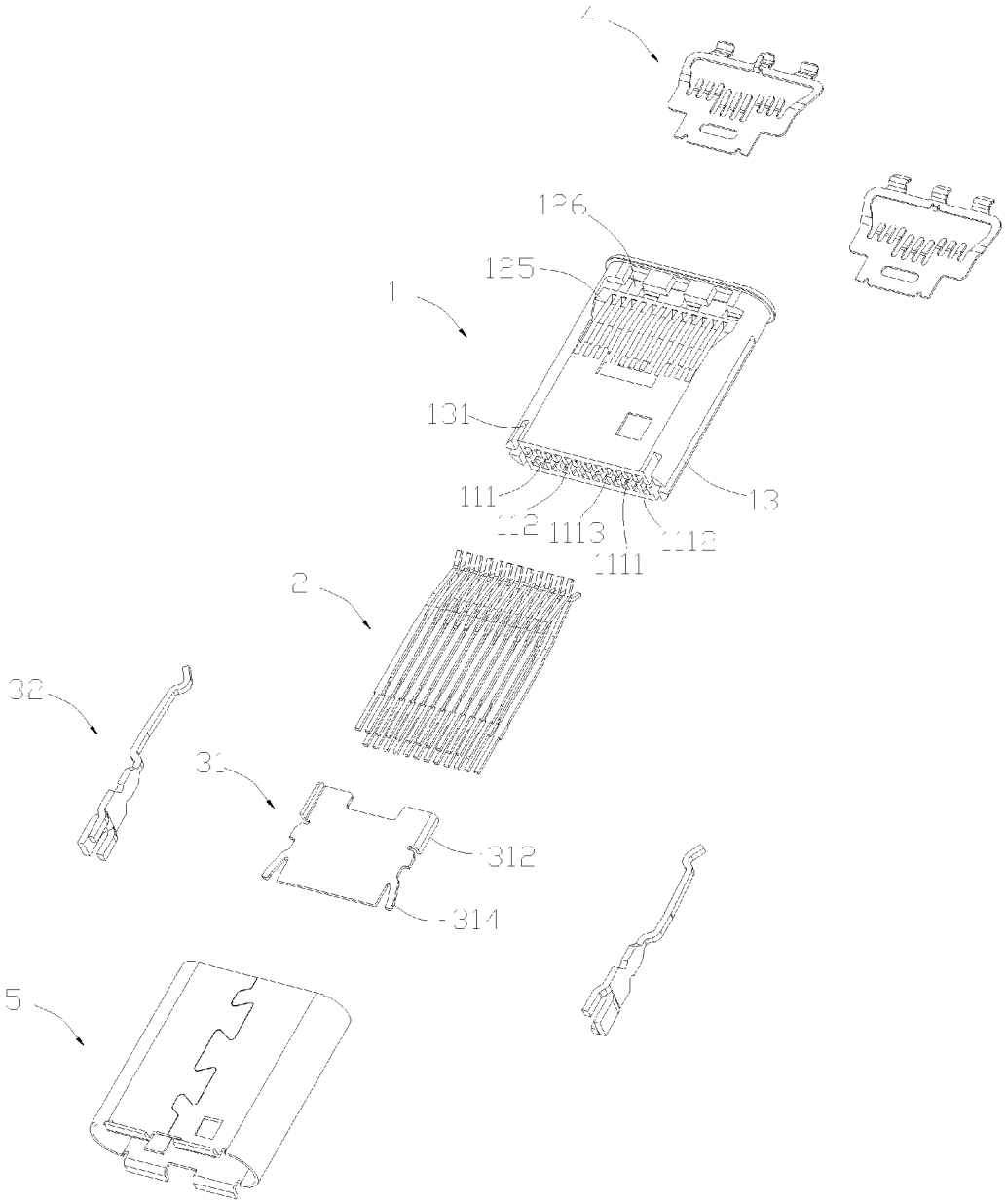
FIG. 4 is a view similar to FIG. 3, while viewed from another aspect.
Figure 5:
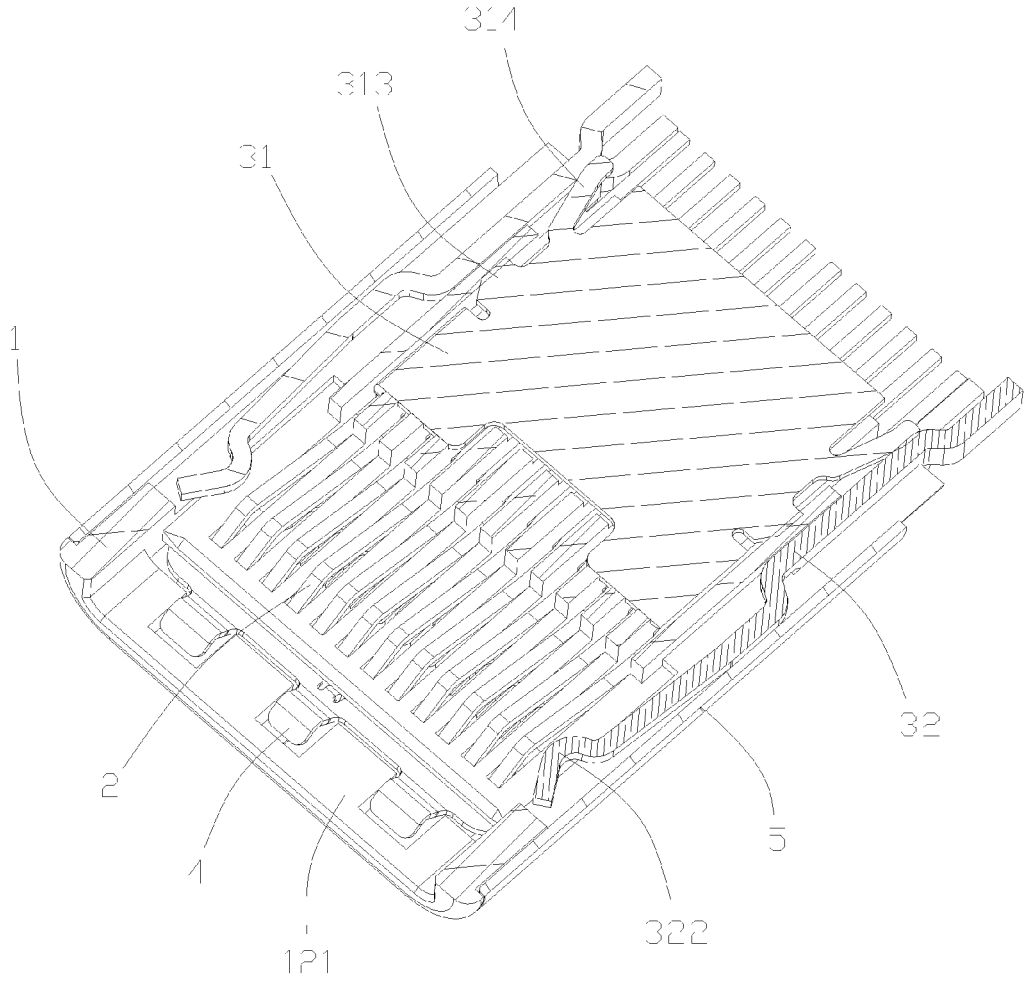
FIG. 5 is a cross-sectional view of the electrical connector shown in FIG. 1 along a transverse direction.
Figure 6:
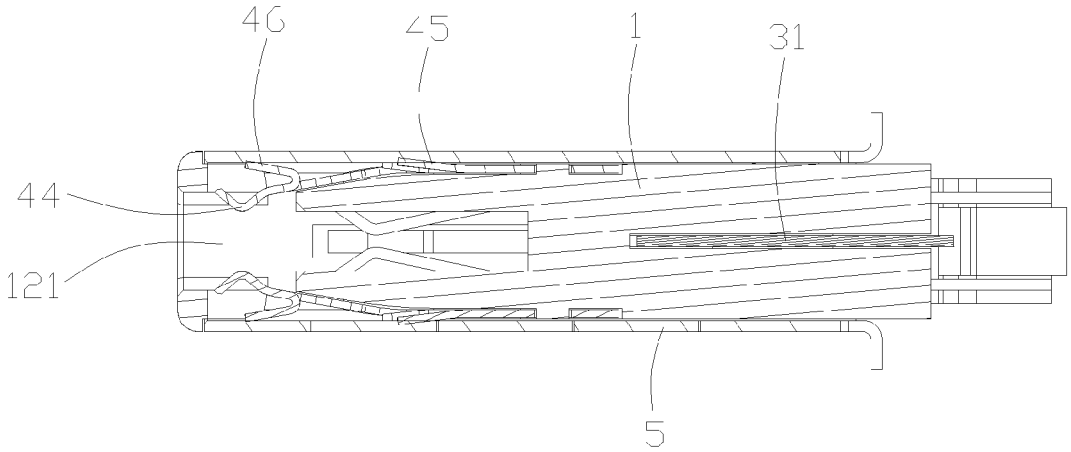
FIG. 6 is a cross-sectional view of the electrical connector shown in FIG. 1 along a longitudinal direction.

Referring to FIGS. 3 and 4, the insulative housing 1 is provided with a body portion 11 and a mating portion 12 forwardly extending from the body portion 11. The body portion 11 defines a contact receiving portion and a middle slot 112 all of which open backwardly. The middle slot 112 does not extend through the body portion 11 forwardly. The mating portion 12 is elliptic and provided with a top wall 122, a bottom wall 123, a pair of side walls 124 and a receiving space 121 formed therebetween. The receiving space 121 opens forwardly.

In the first embodiment, the contact receiving portion composes of a plurality of passageways 111. The passageways 111 extend through the body portion 11 along a front to back direction. The middle slot 112 separates the passageways 111 into two parts which comprise upper passageways 1111 and lower passageways 1112. The contact 2 are arranged in two rows and retained in corresponding upper and lower passageways 1111, 1112 respectively. Each passageway 111 is provided with a pair of securing recesses 1113 further depressed from two inner side walls thereof. Each contact 2 has a securing portion 21 retained in the securing recesses 1113, a contact arm 22 forwardly extending into the receiving space 121 and a connecting portion 23 backwardly extending out of the body portion 11. The contact arm 22 possesses a V-shaped contact portion 221 provided at a free end thereof. The contact portions 221 in two rows are located at upper and lower sides of the receiving space 121 respectively and face to each other, therefore a tongue of a mating connector (not shown) will be sandwiched between the contact portions 221.

The insulative housing 1 is further provided with a pair of elongated slots 13 at two sides thereof and a pair of notches 131 respectively formed at a rear portion of the elongated slots 13. The notches 131 are recessed upwardly and downwardly from inner surfaces of the elongated slots 13. The elongated slots 13 open sideward. In a transverse direction, the elongated slots 13 communicate with the receiving space 121 at a front side thereof and communicate with the middle slot 112 at a rear side thereof.

Each of the top wall 122 and bottom wall 123 defines a recess 125 recessed from the outer surfaces thereof, an indention 126 communicating the recess 125 and the receiving space 121, a plurality of apertures 128 extending therethrough along an up to down direction and a plurality of stalls 129 between adjacent apertures 128. The apertures 128 communicate with the recesses 125 and locate behind the indentions 126. The contact portions 221 correspond to the apertures 128 along the up to down direction, therefore, the apertures 128 can supply a floating space to the contact portions 221, and the mating connector would be inserted conveniently. The indention 126 extends through the top wall 122 or bottom wall 123 along a transverse direction. Besides, each of the top wall 122 and bottom wall 123 further defines a plurality of cutouts 127. The cutouts 127 are recessed forwardly from the front inner surfaces of the indentions 126.

The contacts 2 comprise a plurality of signal contacts 24 and grounding contacts 25. In each row of the contacts 2, the grounding contacts 25 are located at two sides, and the signal contacts 24 are located between the grounding contacts 25. Besides, the signal contacts 24 in each row comprise three pairs of differential signal contacts and some other contacts between adjacent differential signal contacts. In the present invention, the contacts 2 in two rows are identical in signal transmission except that they are arranged reversely, therefore the mating connector can mate with the electrical connector 100 in the pros and cons.

Referring to FIGS. 1 to 6, the grounding member 3 is provided with a middle grounding sheet 31 and a pair of locking arms 32 projecting into the receiving space 121. The middle grounding sheet 31 is fixed in the body portion 11, and spaces apart from the contacts 2 along the up to down direction. In the first embodiment of the present invention, the middle grounding sheet 31 and the locking arms 32 are molded separately. The middle grounding sheet 31 is positioned in the middle slot 112. The locking arms 32 are arranged at two sides of the middle grounding sheet 31 and secured in the elongated slots 13. The locking arms 32 electrically connect with the middle grounding sheet 31.

The middle grounding sheet 31 is provided with a sheet portion 311, a pair of bending portions 312 upwardly or downwardly bending from front two sides thereof, a plurality of barbs 313 outwardly extending from two sides thereof, and a pair of resilient strips 314 extending outwardly from rear two sides thereof. The sheet portion 311 is received in the middle slot 112. The barbs 313 engage with the inner side walls of the middle slot 112 for fixing the middle grounding sheet 31 to the body portion 11. The free ends of the bending portions 312 extend to the passageways 111 and contact with the grounding contacts 25, therefore the middle grounding sheet 31 can prevent the upper and lower rows of contacts 2 from interfering with each other and performance to prevent EMI between the two rows of the contacts 2. The resilient strips 314 protrude into the elongated slots 13 to contact with the locking arms 32. The resilient strips 314 and the sheet portion 311 form gaps therebetween. The gaps can supply deforming space for the resilient strips 314.

Each of the locking arm 32 is provided with an intermediate portion 321 retained in the notches 131, a locking portion 322 extending forwardly from the intermediate portion 321, a grounding tab 323 inwardly extending from a rear end of the intermediate portion 321, and an engaging tab 324 outwardly extending from a rear end of the intermediate portion 321. The intermediate portion 321 is provided with a number of barbs 3211 to engage with the inner walls of the notches 131. The resilient strips 314 of the middle grounding sheet 31 abut against the intermediate portion 321. The grounding tabs 323 connect with the grounding contacts 25 or a circuit board or a grounding cable (not shown). When the grounding tabs 323 connect with the grounding cable, the grounding cable is sandwiched between the grounding tabs 323 and the engaging tabs 324. As described above, the locking arm 32 can not only be used to lock the mating connector, but also to prevent EMI in the receiving space 121.

The shield blades 4 are located at outside of the receiving space 12 and space apart from the contacts 2 along the up to down direction. In detail, the shield blades 4 are received in the recesses 125 of the upper and lower walls 122, 123. Each of the shield blades 4 is formed with a front bracket 41, a rear bracket 42, a pair of side brackets 43, a plurality of inner grounding arms 44 and a plurality of outer grounding arms 45 extending beyond the upper or lower walls 122, 123. The front bracket 41 is received in the indentions 126. The rear bracket 42 is located behind the apertures 128. The inner grounding arms 44 extend forwardly and inwardly from the front bracket 41, and protrude into the receiving space 121 through the indentions 126. The outer grounding arms 45 extend forwardly and outwardly from the rear bracket 42. The outer grounding arms 45 are located at outside of the stalls 129 and correspond to the stalls 129 along the up to down direction. Therefore, the outer grounding arms 45 are located between adjacent contacts 2 along the transverse direction to prevent disturb or EMI between adjacent contacts 2.

The inner grounding arms 44 comprise a pair of external arms 442 at two sides and an internal arm 441 between the external arms 442. Besides, each shield blade 4 is further provided with a resisting arm 46 outwardly extending from the front bracket 41, and the resisting arm 46 corresponds to the internal arm 441 along the up to down direction.

The outer shield 5 has an upper wall 51, a lower wall 52 and a pair of connecting walls 53 connecting two sides of the upper wall 51 and the lower wall 52. The outer grounding arms 45 resist the upper wall 51 or the lower wall 52 outwardly.

Referring to FIGS. 7 to 11, in accordance with a second preferred embodiment of the present invention, an electrical connector 100' comprise an insulative housing 1', contact modules, grounding member 3', shield blades 4' and outer shield 5' too; wherein the shield blades 4' and outer shield 5' is similar to them described in the first embodiment, there will not be described hereinafter. The difference between the second embodiment and the first embodiment will be described in detail hereinafter.

Figure 7:
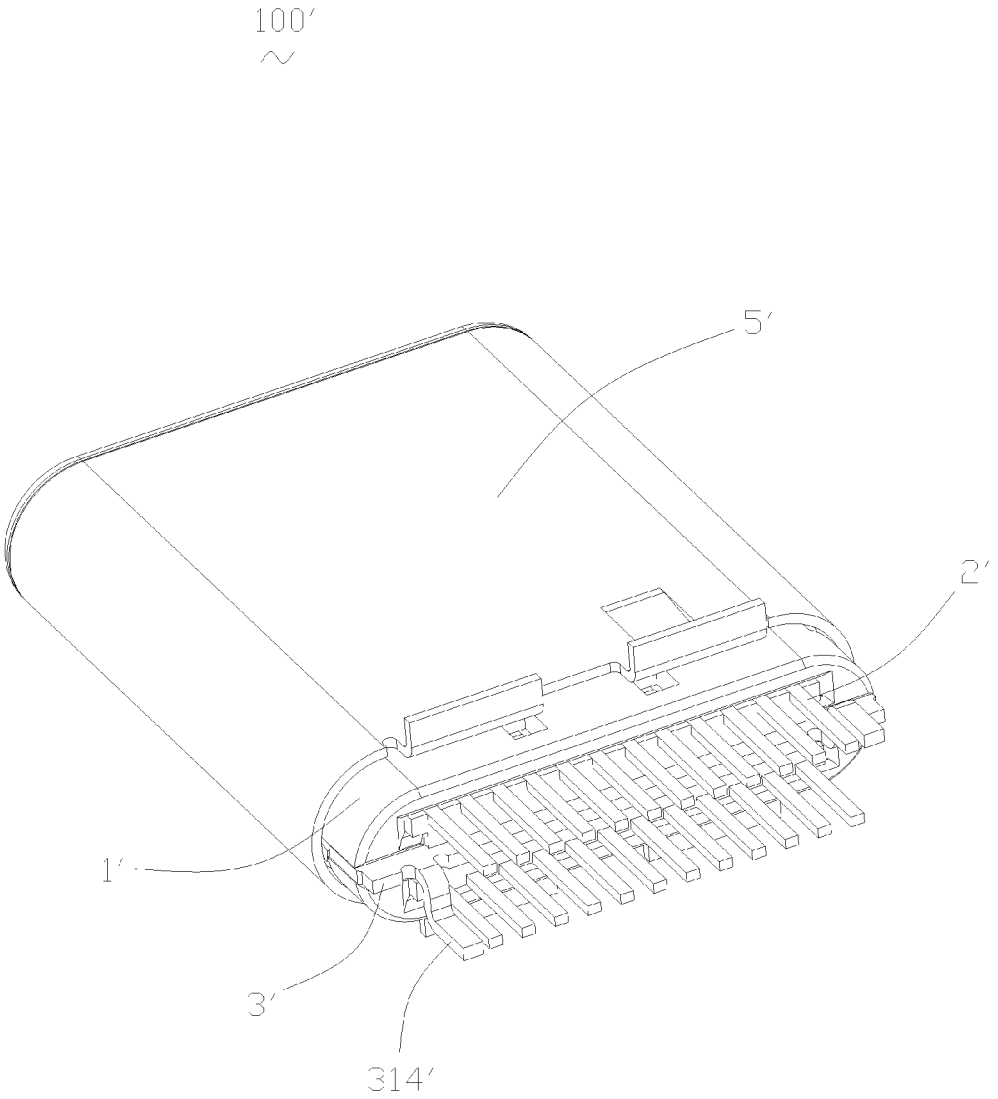
FIG. 7 is a perspective view illustrating a second embodiment of an electrical connector in the present disclosure.
Figure 8:
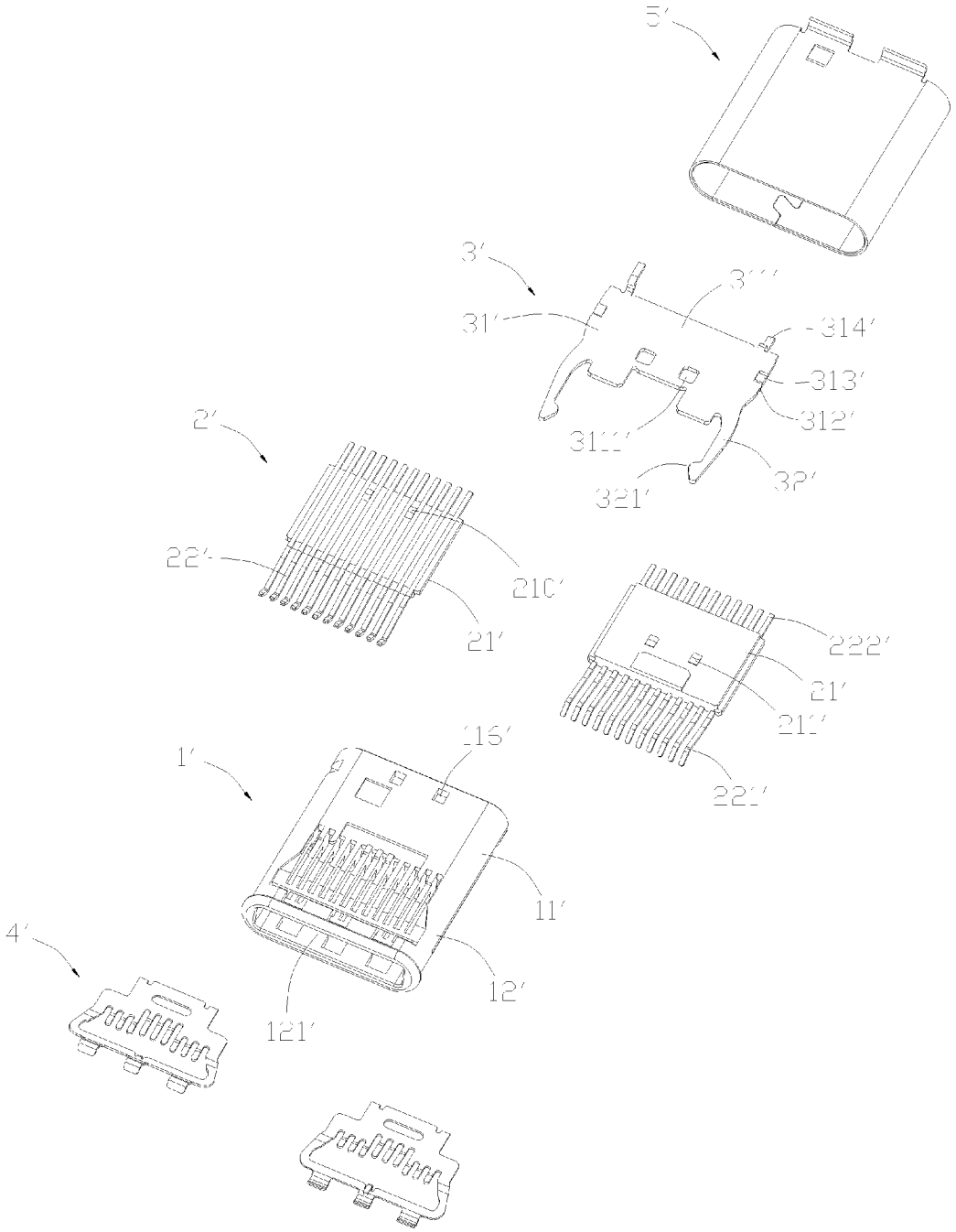
FIG. 8 is an exploded view of the electrical connector shown in FIG. 7.
Figure 9:
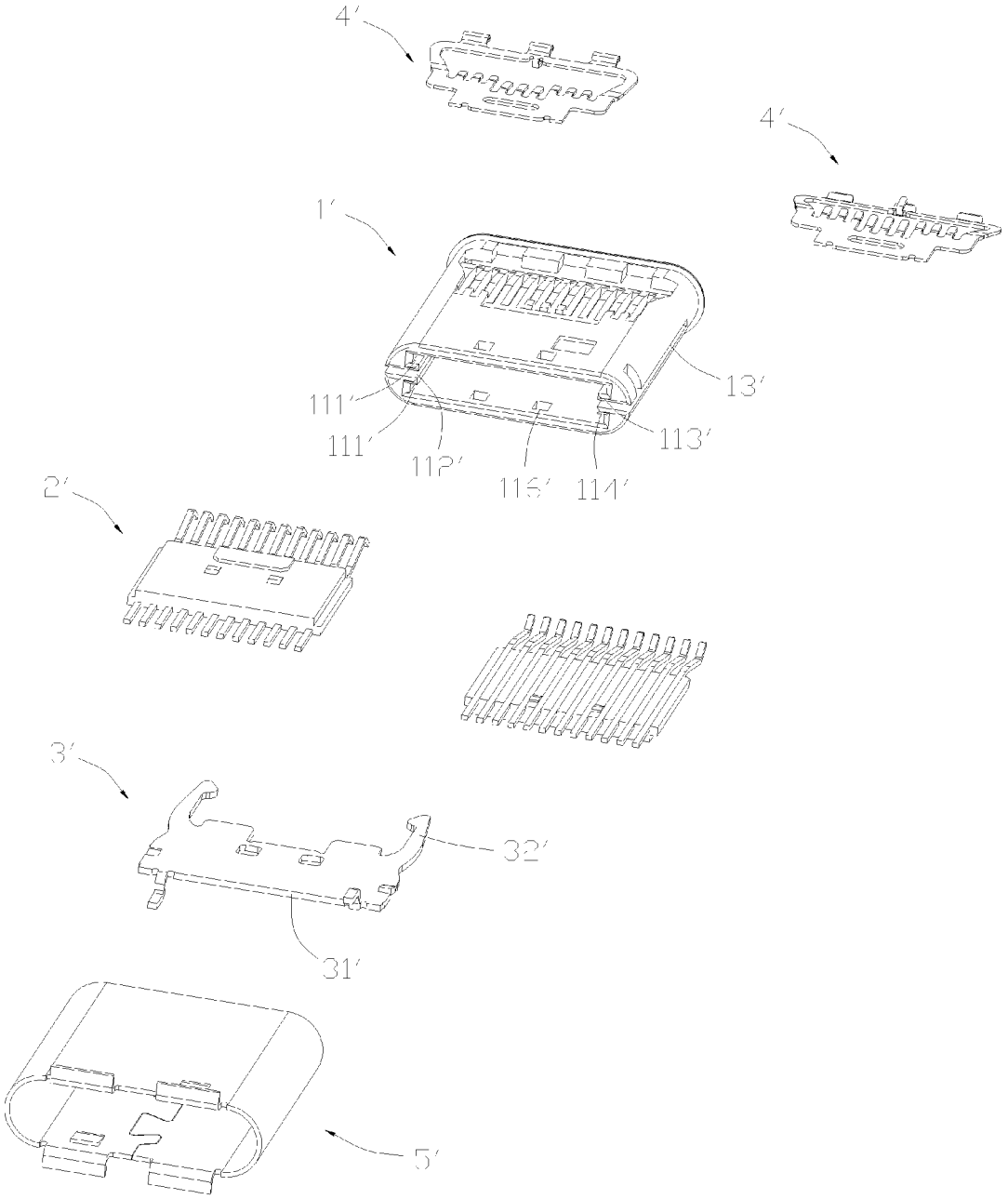
FIG. 9 is a view similar to FIG. 8, while viewed from another aspect.
Figure 10:
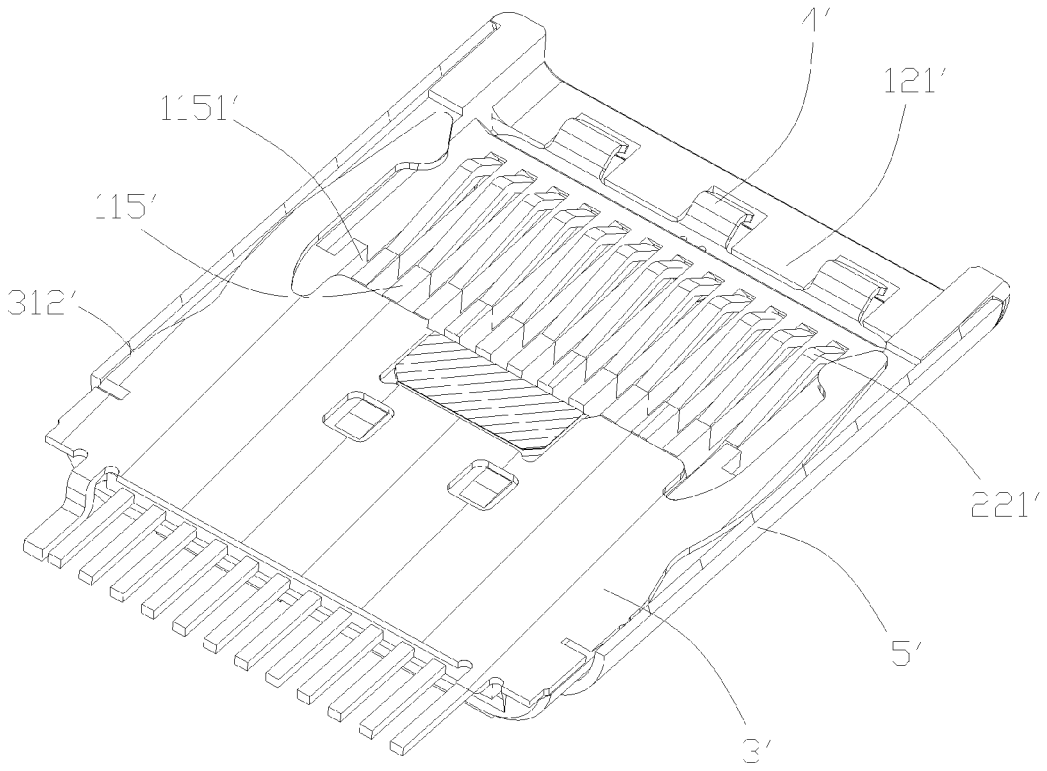
FIG. 10 is a cross-sectional view of the electrical connector shown in FIG. 7 along a transverse direction.
Figure 11:
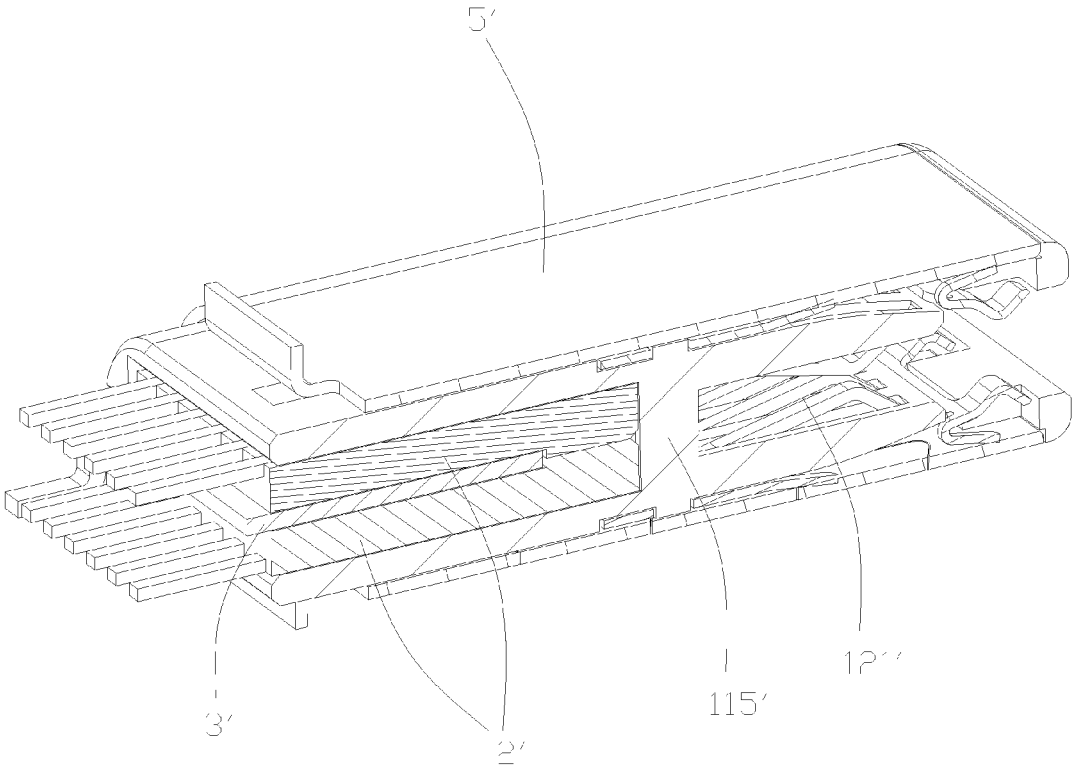
FIG. 11 is a cross-sectional view of the electrical connector shown in FIG. 7 along a longitudinal direction.

Referring to FIGS. 7 to 9, different from the first embodiment, the contact receiving portion 111' of the insulative housing 1' comprise an upper cavity and a lower cavity. The upper and lower cavities are located at upper and lower sides of the middle slot 112' respectively, and communicate with the middle slot 112' along the up to down direction.

The electrical connector 100' in the second embodiment comprises a pair of contact modules 2' arranged in the up to down direction. The contact modules 2' are fixed in the upper and lower cavity respectively. Each contact module 2' is provided with an insulator 21' and a plurality of contacts 22' retained in the insulator 21'. In the present embodiment, the contacts 22' are insert-molded in the insulator 21'. Each contact 22' has a contact portion 221' forwardly extending out of the insulator 21' and a connecting portion 222' backwardly extending out of the insulator 21'. Each of the top and bottom walls of the insulative housing 1' defines a pair of mounting holes 116'. The insulators 21' are formed with protrusions 210' to engage with the mounting holes 116'.

The body portion 11' of the insulative housing 1' is formed with a pair of upper blocks 113' inwardly projecting from two inner side walls of the upper cavity and a pair of lower blocks 114' inwardly projecting from two inner side walls of the lower cavity. The upper blocks 113' are located at a lower side of the upper cavity to support the upper contact module 2'. The lower blocks 114' limit the lower contact module 2' from moving along the up to down direction. Besides, the body portion 11' has a divided wall 115' between the contact receiving portion 111' and the receiving space 121'. The divided wall 115' defines a plurality of through holes 1151' extending therethrough along the front to back direction. The contact portions 221' pass through the through holes 1151' and are received in the receiving space 121'.

Furthermore, referring to FIGS. 7 to 10, different from the grounding member 3 of the first embodiment, the middle grounding sheet 31' and the locking arms 32' are molded integrally in the second embodiment. The locking arms 32' extend from front two sides of the middle grounding sheet 31'. Each locking arm 32' has a locking portion 321' protruding into the receiving space 121'. For receiving the middle grounding member 3', the middle slot 112' extends through the body portion 11' along the transverse direction. The insulative housing 1' is further provided with a pair of elongated slots 13' at two sides thereof. The elongated slots 13' open sideward and communicate with the receiving space 121' along the transverse direction. The elongated slots 13' is located at front of the middle slot 112' and communicate with the middle slot 112' along the front to back direction.

The middle grounding sheet 31' is provided with a sheet portion 311', a number of barbs 312 outwardly protruding from two sides of the sheet portion 311', a pair of tabs 313' tore from two sides of the sheet portion 311', and a pair of grounding legs 314' extending from a rear end of the sheet portion 311'. The sheet portion 311' is received in the middle slot 112' to prevent the contacts 22' of the two contact modules from disturbing with each other. The sheet portion 311' defines a pair of holes 3111'. The insulators 21' are formed with protrusions 211' to engage with the holes 3111'. The barbs 312' abut against with the inner wall of the outer shield 5'. The tabs 313' resist upper inner wall or lower inner wall of the middle slot 112' for fixing the middle grounding sheet 31' to the middle slot 112'.

The grounding legs 314' comprise an upper leg extending upwardly and backwardly, and a lower leg extending downwardly and backwardly. The upper leg is aligned with the connecting portions 222' of the contacts 22' of the upper contact module. The lower leg is aligned with the connecting portions 222' of the contacts 22' of the lower contact module.

In the first and second embodiments of the present invention, the grounding member 3, 3' is assembled to the body portion 11, 11', however, in an alternative aspect, the grounding member 3, 3' can be insert-molded in the body portion 11 also.

As described above, the middle grounding sheet 31, 31' of the grounding member 3, 3' can prevent the upper and lower contacts 2, 22' from disturbing with each other and performance to prevent EMI between the upper and lower contacts 2, 22'; besides, the locking arms 32, 32' electrically connect with the middle grounding sheet 31, 31' which can prevent EMI in the receiving space 121, 121'. At the same time, the locking arms 32, 32' can lock the mating connector stably. Therefore, the electrical connector 100, 100' will have a sufficient prevention from EMI and a reliable signal transmission.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector, comprising:

an insulative housing having a body portion and a mating portion forwardly extending from the body portion, the mating portion being provided with a top wall, a bottom wall, a pair of side walls and a receiving space formed therebetween, the receiving space opening forwardly;

at least a contact module having a plurality of contacts retained on the insulative housing, each contact having a contact portion forwardly extending into the receiving space and a connecting portion backwardly extending out of the body portion; and a grounding member having a middle grounding sheet and a pair of locking arms projecting into the receiving space, the middle grounding sheet being fixed in the body portion and spacing apart from the contacts along an up to down direction, and the locking arms electrically connecting with the middle grounding sheet.

2. The electrical connector as claimed in claim 1, wherein the contacts comprises two grounding contacts at lateral sides thereof, and the middle grounding sheet is formed with a pair of bending portions upwardly or downwardly protruding to contact with the grounding contact.

3. The electrical connector as claimed in claim 1, wherein the middle grounding sheet and the locking arms are molded separately, and the locking arms are arranged at two sides of the middle grounding sheet, the middle grounding sheet having a pair of resilient strips extending outwardly from two sides thereof, each locking arm being provided with an intermediate portion abutting against the resilient strip, a locking portion extending forwardly from the intermediate portion and an engaging tab backwardly extending from a rear end of the intermediate portion.

4. The electrical connector as claimed in claim 3, wherein the contacts comprises two grounding contacts at lateral sides thereof, and each locking arm is provided with a grounding tab extending inwardly from a rear end of the intermediate portion thereof to contact with the grounding contacts or a circuit board or a grounding cable.

5. The electrical connector as claimed in claim 1, further comprising:

a pair of shield blades locating at outside of the receiving space, each shield blade having a plurality of inner grounding arms and outer grounding arms, the inner grounding arms protruding into the receiving space, and the outer grounding arms protruding beyond the top wall or bottom wall; and an outer shield surrounding the insulative housing, the outer shield having an upper wall, a lower wall and a pair of connecting walls connecting two sides of the upper wall and the lower wall;

wherein the outer grounding arms resist the upper wall or the lower wall of the outer shield outwardly.

6. The electrical connector as claimed in claim 5, wherein the top wall and bottom wall of the insulative housing are formed with a plurality of apertures and a plurality of stalls between adjacent apertures, the apertures corresponding to the contact portions of the contacts along the up to down direction, the outer grounding arms being located at outside of the stalls and corresponding to the stalls.

7. The electrical connector as claimed in claim 6, wherein each shield blade has a rear bracket, a front bracket and a pair of side brackets, the outer grounding arms extending forwardly and outwardly from the rear bracket, the inner grounding arms extending forwardly and inwardly from the front bracket.

8. The electrical connector as claimed in claim 7, wherein each of the top wall and bottom wall defines a recess recessed from the outer surface thereof and an indention communicating the recess and the receiving space, the shield blade being received in the recess, and the inner grounding arms passing through the indention.

9. The electrical connector as claimed in claim 8, wherein the indentions extend through the top wall of bottom wall along a transverse direction, the front brackets being received in the indentions, and the inner grounding arms comprising a pair of external arms at two sides and an internal arm between the external arms, the shield blade is further provided with a resisting arm outwardly extending from the front bracket, and the resisting arm corresponding to the internal arm along the up to down direction.

10. The electrical connector as claimed in claim 1, wherein the body portion defines a contact receiving portion and a middle slot all of which open backwardly, and the middle grounding sheet is received in the middle slot, the contacts being fixed in the contact receiving portion.

11. The electrical connector as claimed in claim 10, wherein the insulative housing defines a pair of elongated slots at two sides thereof, and the locking arms are received in the elongated slots, the elongated slots communicating with the receiving space at a front side thereof and communicating with the middle slot at a rear side thereof.

12. The electrical connector as claimed in claim 10, wherein the contact receiving portion composes of a plurality of passageways extending through the body portion along a front to back direction, the middle slot separating the passageways into two parts which comprise upper passageways and lower passageways, the contacts being arranged in two rows which are retained in upper and lower passageways respectively, and the contact portions of the two rows contacts being located at upper and lower sides of the receiving space respectively.

13. The electrical connector as claimed in claim 1, wherein the middle grounding sheet and the locking arms are molded integrally, and the locking arms extend from front two sides of the middle grounding sheet, each locking arm having a locking portion protruding into the receiving space.

14. The electrical connector as claimed in claim 13, wherein the middle grounding sheet is provided with a grounding leg at a rear side thereof to electrically connect with a circuit board or a grounding cable.

15. The electrical connector as claimed in claim 13, wherein the body portion defines a contact receiving portion and a middle slot all of which open backwardly, and the middle slot extending through the body portion along a transverse direction; the middle grounding sheet being received in the middle slot, the contacts being fixed in the contact receiving portion; the insulative housing further defining a pair of elongated slots at two sides thereof, and the elongated slots communicating with the receiving space along the transverse direction and communicating with the middle slot along a front to back direction.

16. The electrical connector as claimed in claim 15, wherein the body portion has a divided wall between the receiving space and the contact receiving portion, and the divided wall defines a plurality of through holes extending therethrough along the front to back direction, the contact portions passing through the through holes and being received in the receiving space.

17. The electrical connector as claimed in claim 15, wherein the electrical connector comprises two said contact modules, and each contact module is provided with an insulator insert-molded around the contacts, the contact receiving portion having an upper cavity and a lower cavity respectively located at upper and lower sides of the middle slot, and the contact modules being receiving in the upper and lower cavity respectively, the contact portions of two contact modules being located at upper and lower sides of the receiving space.

18. The electrical connector as claimed in claim 17, wherein the upper cavity, the middle slot and the lower cavity communicate with each other along the up to down direction.

19. The electrical connector as claimed in claim 17, wherein the body portion is formed with a pair of upper blocks and a pair of lower blocks projecting from two inner side walls of the upper and lower cavities respectively, and the upper blocks support the upper contact module, and the lower blocks limiting the lower contact module from moving along the up to down direction.

20. The electrical connector as claimed in claim 17, wherein the middle grounding sheet defines at least a hole, the insulator is formed with protrusion to engage with the hole.

* * * * *